United States Patent [19]

Kelley

[11] 4,146,349

[45] Mar. 27, 1979

[54] MINE ROOF SUPPORT METHOD AND APPARATUS

[76] Inventor: Jay H. Kelley, 3292 University Ave., Morgantown, W. Va. 26505

[21] Appl. No.: 899,901

[22] Filed: Apr. 26, 1978

Related U.S. Application Data

[63] Continuation-in-part of Ser. No. 772,015, Feb. 25, 1977, Pat. No. 4,091,628, which is a continuation-in-part of Ser. No. 727,024, Sep. 27, 1976, abandoned.

[51] Int. Cl.[2] ..... E21D 15/02

[52] U.S. Cl. ..... 405/288

[58] Field of Search ..... 61/45 C, 45 R, 42, 84, 61/85, 63; 248/354 R, 357; 299/10, 11

[56] References Cited

U.S. PATENT DOCUMENTS

| | | | |
|---|---|---|---|
| 730,677 | 6/1903 | Marcus | 61/84 |
| 1,049,135 | 12/1912 | Nellen | 61/45 C |
| 1,229,323 | 6/1917 | Roby | 61/84 UX |
| 1,451,840 | 4/1923 | Novotny | 61/45 C |
| 1,858,719 | 5/1932 | Queens | 61/45 C X |
| 2,036,490 | 4/1936 | Nellson et al. | 61/45 C |
| 2,371,789 | 3/1945 | Batten | 61/45 C |

FOREIGN PATENT DOCUMENTS

| | | | |
|---|---|---|---|
| 219507 | 10/1968 | U.S.S.R. | 61/45 C |

*Primary Examiner*—Dennis L. Taylor

*Attorney, Agent, or Firm*—Thomas H. Murray; Clifford A. Poff

[57] ABSTRACT

A support for a mine opening includes an elastic plate member with a preformed curvature across its length. Two props at each end of the plate member provide support after emplacement into a load-bearing contact with the roof stratum in a flattened or near flattened configuration to exert substantially uniform pressure against the roof stratum. Rectangular tubes form chock blocks connected to the ends of the plate member. Each chock block includes a clevis to retain the ends of the two props. A spacer maintains a small clearance between the roof and the terminal end portions of the plate member and an anchor pin connects each chock block to the plate member.

9 Claims, 4 Drawing Figures

MINE ROOF SUPPORT METHOD AND APPARATUS

CROSS-REFERENCE TO RELATED APPLICATIONS

This application is a continuation-in-part of application Ser. No. 772,015, filed Feb. 25, 1977, now U.S. Pat. No. 4,091,628, which is a continuation-in-part of application Ser. No. 727,024, filed Sept. 27, 1976, now abandoned.

BACKGROUND OF THE INVENTION

This invention relates to a roof support plate with a pre-formed shape which is flattened to a substantial extent upon emplacement for exerting pressure against the roof of a mine opening where the support plate makes contact. More particularly, the present invention relates to such a roof support plate together with means for maintaining the roof support plate emplaced in such a manner so as to prevent buckling due to reverse bending stresses.

As is known in the art, mine openings have been supported in the past by timbers, concrete, metallic structures and more recently by roof bolts. Because these support devices are of such a well-known character, it is deemed unnecessary to set forth a detailed explanation thereof. Experimental devices have been developed for supporting the entries of mine openings wherein these devices take the form of mobile roof supports that are hydraulically operated. Other suggested measures include the use of plastic adhesive to impregnate the roof strata, or using shotcrete or coating techniques for protecting roof strata from moisture and oxygen. However, these measures are only partially effective in supporting rock strata. In recent years, longwall mining techniques brought about the use of roof chocks and roof shields. These devices are self-advancing hydraulically to hold the roof in the immediate area of the longwall mining machine away from the machine as well as the operators therefor.

As mine openings are developed into deeper strata, the pressure becomes increasingly severe to the extent that experience with such mine operations reveal the development of a far greater number of rib "bumps" and other failures of the rib. The heavy pressures on the rib line tend to spall off the vertical wall whereby the vertical wall appears to behave as a plastic material in failure. Also, as mines are opened into seams characterized by weaker roofs, ribs and bottoms, existing types of roof supports will be even less satisfactory. Known existing types of roof supports fail to solve all the problems presented by present-day mining operations. The more costly types of roof supports, such as reinforced concrete and longwall shields, are quite effective but, at the same time, have the acute disadvantage of excessive cost. The high cost of a roof support in longwall mining operations can usually be tolerated because the roof support elements are not lost but, instead, the elements are advanced as the mining operations proceed on the longwall face. Thus, these elements can be used over and over again. However, in the case of room and pillar mining procedures, expendable roof support techniques are common-place and the short usable life of the panel entries or pillar splits usually do not warrant the cost of expensive roof support devices. A relatively small amount of coal is recoverable from the dispersed openings of the room and pillar mining operations and this severely limits the economical feasibility of roof supports. For these types of mining operations, a serious need exists for an inexpensive but effective roof support.

SUMMARY OF THE INVENTION

It is an object of the present invention to provide a roof support in the form of an arched plate member which is relatively inexpensive but extremely effective to support the roof stratum of a mine opening.

It is another object of the present invention to provide an arched roof support through the use of a pre-formed plate of high tensile material which is emplaced to exert a substantially uniform pressure against the middle portion of the roof while the side edges of the plate are carried by prop members.

It is a further object of the present invention to provide an elastic arched plate having a pre-formed curvature for emplacement by supporting one end of the plate through a chock member coupled to props extending to the floor and then raising the opposite end of the plate to a height sufficient to flatten the plate and thereby impart a precalculated and substantially uniform pressure upon the roof of a mine opening through the further support by props extending from the floor while coupled by a chock member to the free end of the plate.

It is a further object of the present invention to provide an arched roof support plate together with spacer means at opposed ends of the plate to prevent any reverse stresses that cause the plate to buckle in midspan upon substantial flattening of the plate against the roof of a mine opening.

According to the present invention, there is provided a support for the roof of a mine opening having a preselected curvature along the length thereof and a sufficient tensile strength to withstand elastic flattening from the preselected curvature against the roof surface of the mine opening, chock means carried on each of the two opposed ends of the plate member, and emplacement prop means engaging the chock means to support the plate while substantially flattened from the preselected curvature through compressively stressing a face surface of the plate member against the roof surface of the mine opening, the emplacement prop means being supported by the floor of the mine opening to maintain elastic flattening of the preselected curvature to said plate against the roof surface.

In the preferred form of support, the chock means include rectangular tubes receiving the ends of the plate member through an interconnection provided by pin members. Spacers are arranged to extend from the chock means to maintain a small clearance between the mine roof and the terminal ends of the plate member to prevent buckling of the plate member.

The present invention further provides a method for supporting the roof stratum of a mine opening by the steps of selecting a generally arch-shaped support plate having a desired width and a length reduced by the arched configuration, arranging spacer members on each of the ends of the support plate to maintain a gap between the mine roof and the terminal ends of the support plate, arranging the selected support plate such that at least one of the ends of the plate curves downwardly from the roof stratum, elastically flattening the support plate along the length thereof against the roof stratum by directing a force upon at least one end of the support plate in a direction toward the roof stratum and thereby compressively stressing the face surface of the central midportion of the plate which contacts the roof stratum and emplace the plate under a prestressing force against the roof stratum and using prop members extending fron the mine floor to maintain the support plate elastically flattened against the mine roof.

These features and advantages of the present invention as well as others will be more fully understood when the following description is read in light of the accompanying drawings, in which.

Figure 1:
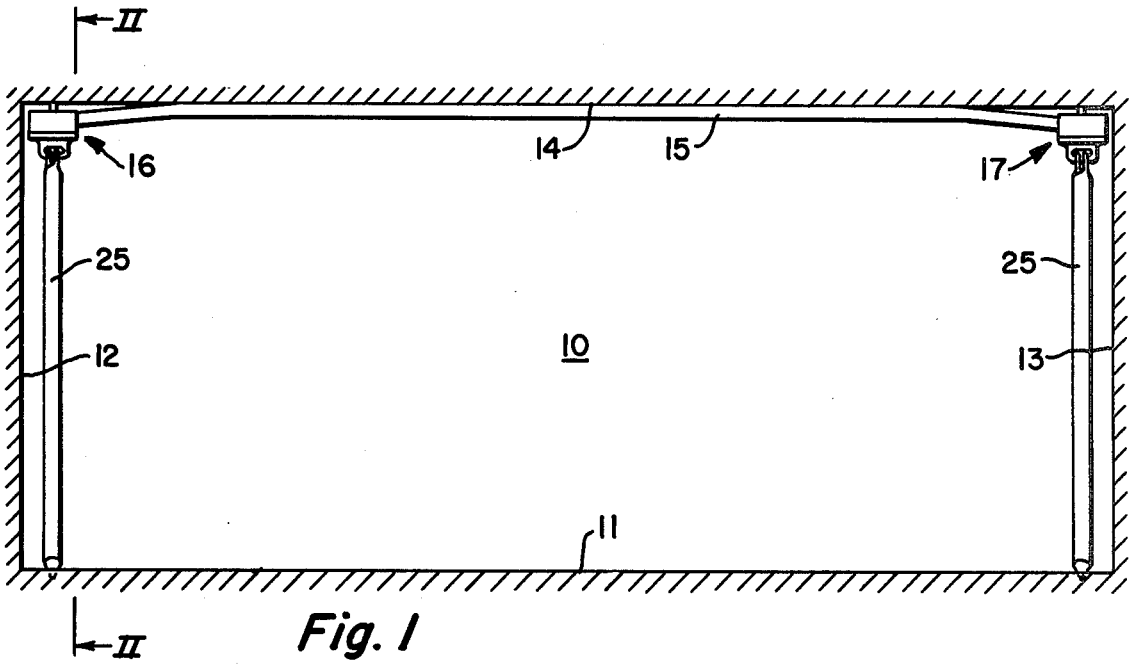
FIG. 1 is an elevational view showing the roof support of the present invention emplaced in a mine opening.

In FIG. 1, there is illustrated a mine opening 10 defined by a floor 11, upstanding side ribs 12 and 13, and an overlying stratum forming a roof surface 14. A preformed elastic roof support plate 15 has a preselected length which may, for example, be 16 feet or some other desired length selected for emplacement against the roof surface 14. When emplaced, the extended length of the plate is less than the distance between the side ribs 12 and 13. The ends of the plate are always spaced from the side ribs to avoid the development of a horizontal force component and end loading which may produce an undesired reverse stress causing the plate to buckle. Moreover, a small clearance such as, for example, 2" is maintained between the ends of the plate and the roof surface to also prevent the development of a horizontal force component, even at the site of an unsmooth roof surface, as well as end loading which may produce an undesired reverse stress and tendency for the plate to buckle.

The elastic roof support plate 15 is preferably a curved band of a parabolic configuration that is preformed. When the plate is braced at its ends against the roof surface in a flattened or near flattened configuration, a substantially uniform pressure along the length of the plate is exerted against the roof surface. The plate consists of material having a high tensile strength. Suitable materials include a hardened carbon steel, alloy steel, high quality aluminum alloy, glass reinforced plastic, ferrous and non-ferrous magnesium alloy metal. A critically important property of the plate forming the roof support is that the material must have sufficient strength under compression to prevent buckling and, at the same time, the material must be capable of developing a sufficient stress so as to exert a uniform force against the roof essentially along the midspan section of the roof. The fibers at the surface of the support plate in contact with the roof are compressively stressed whereas the fiber at the surface of the plate facing the mine floor are stressed in tension. According to the present invention and as shown in FIGS. 1–4, affixed to the ends of the roof support plate 15 are chock members 16 and 17 which are removable or, if desired, a permanent part of the support plate. The chock members or through additional means such as pins 20 maintain the clearance between the ends of the plate 15 and the roof surface 14. The chock members 16 and 17 each include a short length of rectangular tubing with an upper wall 19 having a plurality of bores therein. Pins 20 extend from above the upper wall 19 into these bores and pass through enlarged bores in the plate for support by resting upon the bottom wall 21 of the chock member. The projected ends of the pins above wall 19 as well as the upper portion of the chock member form a spacer structure to maintain the small clearance between the roof surface and the actual ends of the roof support plate as described hereinbefore.

Figure 2:
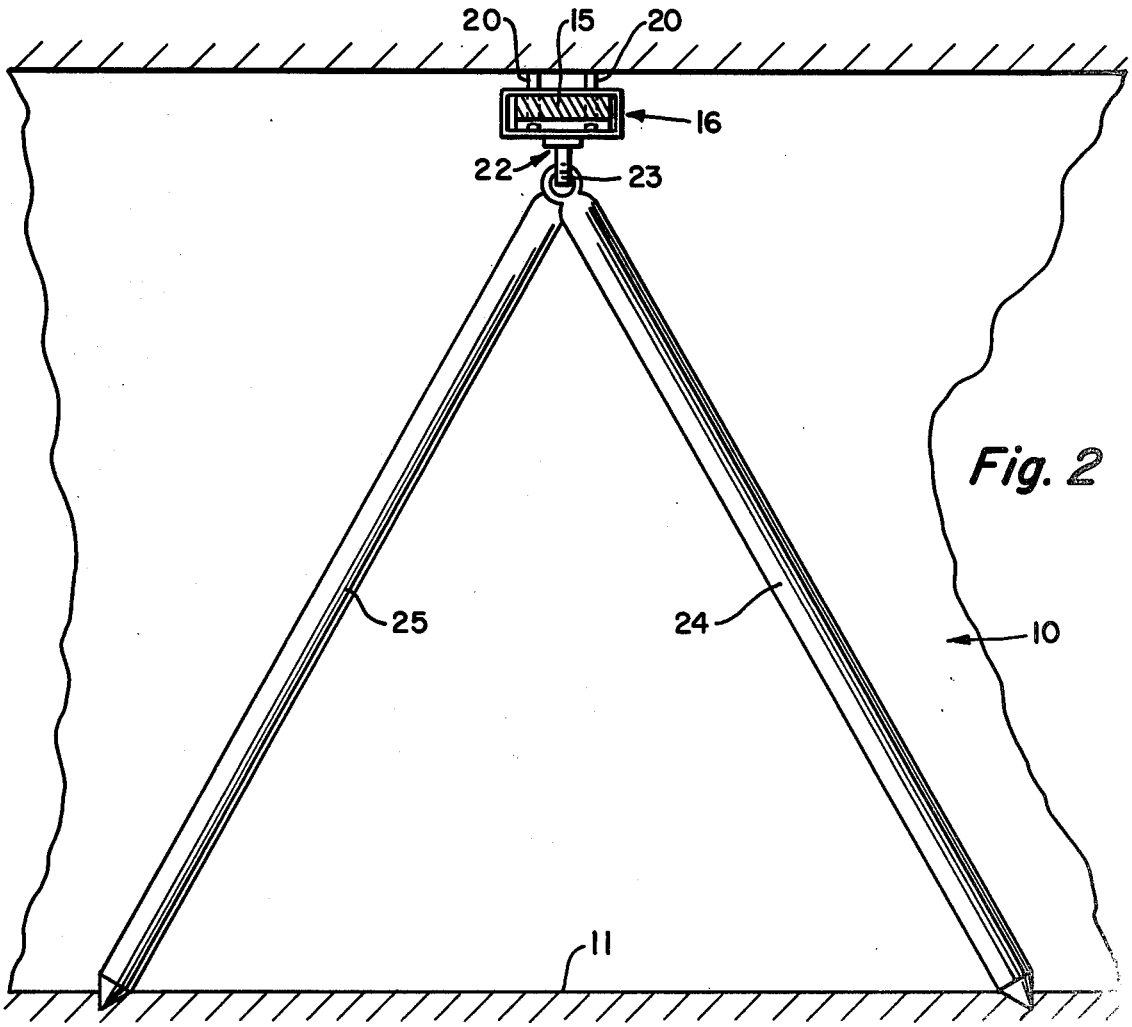
FIG. 2 is an enlarged view taken along lines II—II of FIG. 1.
Figure 3:
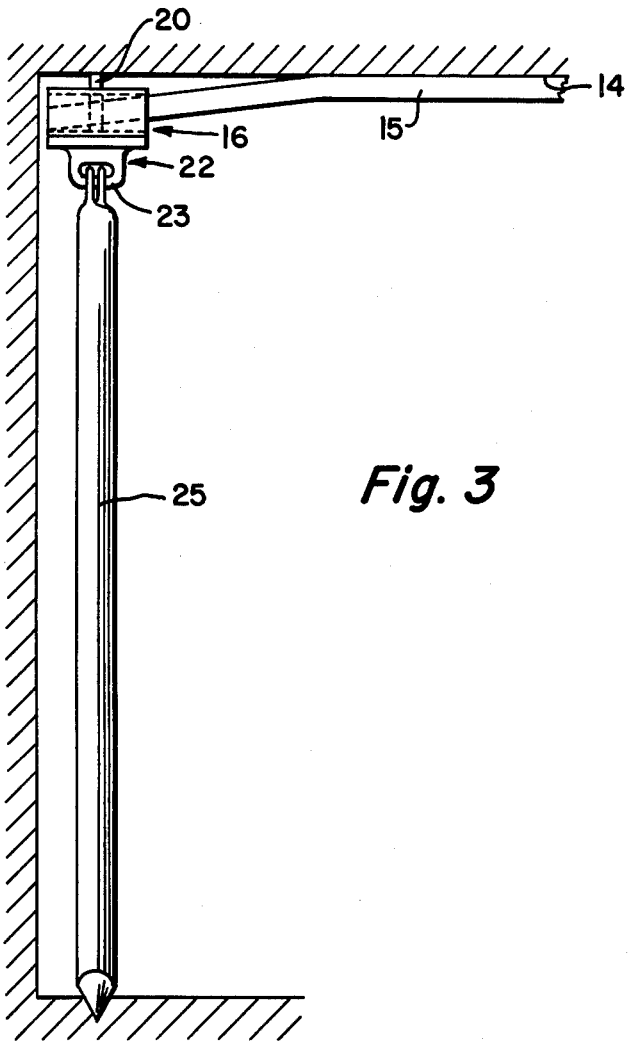
FIG. 3 is an enlarged partial, elevational view similar to FIG. 1 and illustrating the roof support of the present invention.
Figure 4:
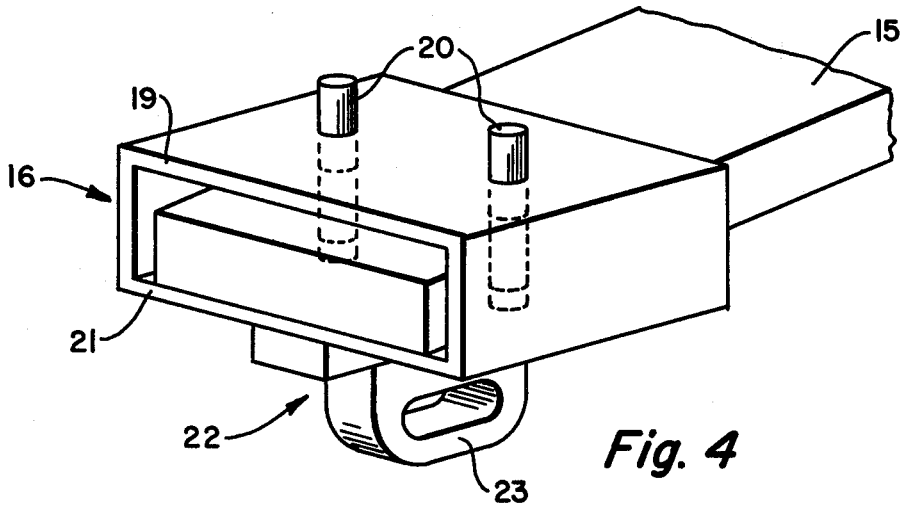
FIG. 4 is a perspective view of a chock member and one end of a roof support plate.

Extending downwardly from the bottom wall 21 of each chock member is a clevis 22 which includes an elongated support pin 23 used to engage and retain the upper ends of two support props 24 and 25. For this purpose, each of the support props includes a ringed end that is permanently received on the pin 23 as shown in FIG. 2. The two post members at the end of the plate have pointed lower ends to bear on the mine floor. Shoe members may be used on the lower ends of the props instead of pointed ends. Two props are used at each end of the support plate to form a redundant support so that in the event one prop becomes dislodged by collision with mining equipment or by bursting of a rib, then support is continuously provided by the remaining prop. Thus, either prop member is constructed with sufficient strength and provided with a length so that an ideal angle of between 10° to 20° to the vertical but no greater than 45°. The props are used for continuous support of the roof plate. Moreover, the roof plate is connected by means of the pin member 20 to the chock members to avoid unintentional dislodgement.

Since the two support props 24 and 25 are fixed in a pivotal member to each end of the chock member, the method of emplacing the roof support is preferably carried out by hand or other means. The roof support plate is supported at one end and then raised at its opposite end by a hydraulic jack or boom from a mining machine.

A typical use of this invention will be in an active mining section where present federal law prevents the mining of an opening beyond a permanent roof support, which in many cases is the last row of roof bolts. The roof support plate, being light in weight when installed would also be considered a permanent roof support so that a mining operation can continue by emplacing six or more such support plates as the mining continues.

Some flexibility can be achieved in the vertical support provided by the props by using different angles and splitting of the feet of the support. Also, adjustments can be made to the vertical dimension or length of the props by either threaded length adjustments to the vertical leg or by a sliding telescopic arrangement with a pin or any other means to adjust the length of the prop. The cross-sectional area of the support prop could be either box-shaped or cylindrical. The material of the support member is preferably steel, aluminum, plastic, etc., or a combination thereof.

Likewise, the roof support plate itself can be of any material as described hereinbefore, but a material which has a significantly large modulus of elasticity.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A support for the roof of a mine opening, said support comprising an elongated plate member having a preselected curvature along the length thereof and a sufficient tensile strength to withstand elastic flattening from said preselected curvature against the roof surface of the mine opening, chock means carried on each of the two opposed ends of said plate member, and emplacement prop means engaging said chock means to support said plate while substantially flattened from said preselected curvature through compressively stressing a face surface of the plate member against the roof surface of said mine opening, said emplacement prop means being supported by the floor of the mine opening to maintain said plate member against the roof surface while elastic flattening from the preselected curvature.

2. The support according to claim 1 further comprising means to couple said chock means to each end of said support plate.

3. The support according to claim 1 wherein said prop means include two props for each end of said elongated plate member.

4. The support according to claim 1 further including clevis means on said chock means to support said prop means for pivotal positioning.

5. The support according to claim 1 further including spacer means extending from said chock means to maintain a gap between the end of said plate member and the mine roof for preventing buckling of the plate member which is compressively stressed against the face surface of the mine roof.

6. The support according to claim 1 wherein said chock means include a rectangular tube adapted to receive the end of said plate member.

7. A method for supporting the roof stratum of a mine opening, said method including the steps of:

selecting a generally arch-shaped support plate having a desired width and a length reduced by the arched configuration thereof, coupling chock members to each of the ends of the support plate to maintain a gap between the mine roof and the terminal ends of the support plate, arranging the selected support plate such that at least one of the ends to the arch-shaped configuration curves downwardly from the roof stratum, elastically flattening the support plate along the length thereof against the roof stratum by directing a force upon at least one end of the support plate in a direction toward the roof stratum to thereby compressively stress the face surface of the central midportion of the support plate in contact with the roof stratum and emplace the support plate under a prestressing force against the roof stratum, and using prop members extending from the mine floor to engage the chock members to maintain the support plate elastically flattened against the mine roof.

8. The method according to claim 7 wherein said step of elastically flattening includes supporting one end of said plate with a prop member extending to the floor of the mine opening, and elevating the remaining free end of the plate toward the roof stratum.

9. The method according to claim 7 including the further step of using a spacer member between the roof stratum and each end of the plate for maintaining a clearance therebetween to prevent buckling of the plate due to reverse stresses.

* * * * *